United States Patent [19]

Grabuschnig et al.

[11] Patent Number: 5,020,575

[45] Date of Patent: Jun. 4, 1991

[54] METHOD AND INSTALLATION FOR FEEDING LONGITUDINAL ELEMENTS TO A WELDING MACHINE FOR GRATES OR GRATINGS

[75] Inventors: Josef Grabuschnig; Rudolf Scherr; Klaus Ritter; Gerhard Ritter, all of Graz, Austria

[73] Assignee: EVG Entwicklungs -u Verwertungs-Gesellschaft m.b.H., Graz, Austria

[21] Appl. No.: 440,772

[22] Filed: Nov. 22, 1989

[30] Foreign Application Priority Data

Nov. 30, 1988 [AT] Austria ..... 2948/88

[51] Int. Cl.[5] ..... B21F 1/02; B21F 11/00; B21F 15/08

[52] U.S. Cl. ..... 140/112; 140/140

[58] Field of Search ..... 140/112, 111, 140; 72/203, 424; 198/418.4, 426, 431–433, 775, 418.1, 418.6, 459

[56] References Cited

U.S. PATENT DOCUMENTS

| | | | |
|---|---|---|---|
| 3,213,898 | 10/1965 | Le Grady et al. | 140/112 |
| 3,405,743 | 10/1968 | Robinson | 140/112 |
| 3,506,108 | 4/1970 | Glasson | 198/459 |
| 4,307,594 | 12/1981 | Steinbock | 72/203 |
| 4,546,633 | 10/1985 | Brauer et al. | 72/252 |
| 4,704,889 | 11/1987 | Poloni et al. | 72/419 |

FOREIGN PATENT DOCUMENTS

| | | | |
|---|---|---|---|
| 323527 | 7/1975 | Austria | 140/112 |
| 333575 | 11/1976 | Austria . | |
| 384968 | 7/1987 | Austria | 140/112 |
| 1034573 | 6/1958 | Fed. Rep. of Germany . | |
| 1456661 | 3/1969 | Fed. Rep. of Germany . | |
| 1552144 | 3/1970 | Fed. Rep. of Germany . | |
| 2051354 | 4/1972 | Fed. Rep. of Germany . | |
| 2115272 | 10/1972 | Fed. Rep. of Germany | 140/112 |
| 2142321 | 3/1973 | Fed. Rep. of Germany | 140/112 |
| 2319003 | 10/1974 | Fed. Rep. of Germany . | |
| 2363369 | 6/1975 | Fed. Rep. of Germany | 140/112 |
| 3143712 | 5/1983 | Fed. Rep. of Germany . | |
| 1510975 | 12/1967 | France . | |
| 1314753 | 4/1973 | United Kingdom | 140/112 |

*Primary Examiner*—Robert L. Spruill

*Attorney, Agent, or Firm*—Frishauf, Holtz, Goodman & Woodward

[57] ABSTRACT

A method and installation for feeding longitudinal elements of round or flat material to a welding machine (41) for grates or gratings, in which method the longitudinal elements (L), cut off from at least one line of longitudinal-element material after straightening of the same, are arranged in a group with selectable spacing, without longitudinal displacement, in the direction transverse to a push-in line (S) to the welding machine (41), are secured in place by a, for example magnetic, holding force and are moved essentially continuously into the push-in line, and in which arrangement the front ends of the longitudinal elements are mutually aligned before delivery of the longitudinal elements to the welding machine.

13 Claims, 5 Drawing Sheets

METHOD AND INSTALLATION FOR FEEDING LONGITUDINAL ELEMENTS TO A WELDING MACHINE FOR GRATES OR GRATINGS

The invention relates to a method and an installation for feeding longitudinal elements to a welding machine for grates or gratings.

BACKGROUND AND PRIOR ART

It is known from German Patent Specifications 2,051,354 and 1,456,661 to feed wire, drawn off from a coil, intermittently through a straightening device by a selectable length, to cut off longitudinal elements and to feed the latter by means of a conveying device transversely to the push-in line to a horizontal magazine which consists of a plurality of chains which can be moved step-by-step and have receiving pockets for one longitudinal wire each. The longitudinal wires, by means of a transporting carriage, are lifted in groups out of the magazine acting as intermediate storage means and are conveyed transversely to the push-in line in front of a stationary delivery device of the welding machine and are delivered to the latter.

A disadvantage in this procedure is the inevitably horizontal and consequently bulky arrangement of the magazine, whose width has to correspond to at least the largest width of the grate to be manufactured. In addition, a relatively low operating speed results, caused by the slow filling of the magazine by means of the intermittently working straightening and cutting device and on account of the use of only one transporting carriage, which has to remain in the delivery position relative to the welding machine until all longitudinal wires have been worked by the welding machine. Furthermore, an infinitely adjustable spacing of the longitudinal wires is not possible.

German Patent Specification 2,319,003 (published Oct. 17, 1974) discloses a feeding mechanism in which a transporting device arranged horizontally and parallel to the welding machine and intended for longitudinal wires is formed by an endless, rotating transverse-conveying device provided with receiving members for the longitudinal wires. The longitudinal wires are conveyed into the receiving members by means of a straightening and cutting device arranged in front of the transverse-conveying device in the direction of the longitudinal wires and movable transversely to the direction of the longitudinal wires. In another embodiment, the longitudinal bars straightened and cut by means of the straightening and cutting device are first of all fed to a supply magazine and then pass via a singularizing device into a further magazine and from the latter into a channel. From this channel, the longitudinal bars are fed by means of a draw-in device to the receiving members of the transverse-conveying device Finally, in a further exemplary embodiment, the longitudinal wires are fed directly from the magazine into the receiving members of the transverse-conveying device.

A disadvantage in the first-mentioned embodiment is the fact that a transverse displacement of the feeding device, consisting of straightening and cutting devices as well as the corresponding feed mechanisms can only be realised by a considerably complex design; on the other hand, in a fixed feeding device, a passing movement of the transverse-conveying device for the purpose of loading with longitudinal wires can only be effected when the welding machine has removed all longitudinal wires from the transverse-conveying device.

The other two embodiments certainly enable round longitudinal wires to be lifted out of the transverse-conveying device and thus also enable the transverse-conveying device to pass directly after the longitudinal wires have been welded to the first cross wires. However, this is not possible in the case of longitudinal elements which are resistant to bending in the longitudinal direction, such as strip-shaped supporting bars disposed edgewise for gratings, since these supporting bars cannot be lifted or lowered in the direction of their narrow side without deforming or twisting.

THE INVENTION

The object of the invention is to avoid the disadvantages described and to specify a method as well as create an installation intended to perform the method, with which an essentially continuous and time-saving feed of longitudinal elements to the welding machine is made possible.

The method according to the invention for feeding longitudinal elements of round or flat material to a welding machine for grates or gratings, in which method elements of predetermined length are cut off from endless longitudinal-element material after straightening of the same, and these longitudinal elements are arranged in a group at predetermined spacing transversely to the push-in or feed line, whereupon the group as a whole is shifted into the push-in line and delivered to the grate-welding machine, is characterized in that the longitudinal elements, cut off from at least one line of longitudinal-element material, are arranged with selectable spacing in a group without relative longitudinal displacement in the group, are secured in place at least temporarily, that is by application of a positioning force thereagainst and are moved essentially continuously into the push-in line, and in that the front ends of the longitudinal elements are mutually aligned before delivery of the longitudinal elements to the welding machine.

In this method, the longitudinal elements are preferably secured in place by magnetic force on a flat surface movable transversely to the push-in line.

Furthermore, the subject-matter of the invention is an installation intended for performing the method and comprising a device for feeding, straightening and cutting to length a line of longitudinal-element material, a singularizing i.e individually separating and conveying device, orientated transversely to the push-in line, for the longitudinal elements, and a distributing device which is arranged downstream from the singularizing and conveying device and with which the longitudinal elements can be moved in groups from the conveying device up to a delivery device of the welding machine; this installation has the features that the conveying device has at least one channel, pivotable about its longitudinal axis, for directly receiving the cut-to-length longitudinal elements without longitudinal displacement of the same and conveying elements which are arranged downstream from the longitudinal-element receiving channel and with which the longitudinal elements, likewise without longitudinal displacement, can be conveyed individually along a feeding duct to the distributing device, and that the distributing device has at least two distributor carriages which are movable independently of one another, are provided with devices for securing the longitudinal elements in place temporarily, that is non-positively with selectable transverse spacing on vertically adjustable supporting surfaces of the carriages and, in accordance with the spacing of the longitudinal elements in the finished grate, can be moved step-by-step relative to the conveying device into a transfer station, that the distributor carriage completely fitted with longitudinal elements, with a supporting surface arranged in an upper, preferably horizontal plane, can be moved from the transfer station into a delivery station of the delivery device of the welding machine, whereas the distributor carriage emptied after delivery of the longitudinal elements, with a supporting surface lowered into a lower, preferably horizontal plane, can be moved back to the conveying device and the supporting surface can be lifted again into the upper plane, that a device for aligning the front ends of the longitudinal elements to be delivered is provided in the delivery station, and that the devices of the installation can be controlled by means of a program control device.

With the invention, an essentially continuous feed of longitudinal elements to the welding machine is achieved with little time used, a high operating speed being ensured at the same time. Furthermore, an important advantage of the invention is that, as a result of the longitudinal elements being secured in place non-positively in a simple manner, an infinitely selectable spacing of the longitudinal wires is made possible. With the invention, both bar-shaped and strip-shaped longitudinal elements of any cross-section or any cross-sectional shape can be fed, combinations of different cross-sections and lengths within an assemblage of longitudinal bars also being possible. According to the invention, both cold-drawn and hot-rolled material can advantageously be worked.

In a preferred embodiment of the invention, the distributing device has a section facing the feeding device and containing the distributor carriages and a section remote from the feeding device and having at least one endless distributor chain which can be driven in the direction of movement of the distributor carriages towards the push-in line.

According to a further feature of the invention, the devices for securing the longitudinal elements in place non-positively on the supporting surfaces of the receiving tables consist of essentially plate-shaped elements having electromagnets which can be switched off.

Furthermore, according to the invention the conveying elements of the conveying device are formed by conveying chains having L-shaped flights. Preferably allocated here to the pivotable longitudinal-element receiving channel of the conveying device are a plurality of pivotable deflecting fingers arranged along the channel and also at least one ejector, with which the longitudinal element can be moved into the feeding duct. In this arrangement, according to the invention, at least two longitudinal-element receiving channels, having allocated deflecting fingers, ejectors as well as conveying elements and feeding ducts can be provided with which longitudinal elements, facultatively of different length can be fed preferably in an alternating manner to the distributing device.

According to a further feature of the invention the feeding device has feed members, straightening tools and cutting devices for at least two lines of longitudinal-element material.

DRAWINGS

Further features and advantages of the invention are described in greater detail below with reference to an exemplary embodiment and the drawing, in which.

Figure 2:
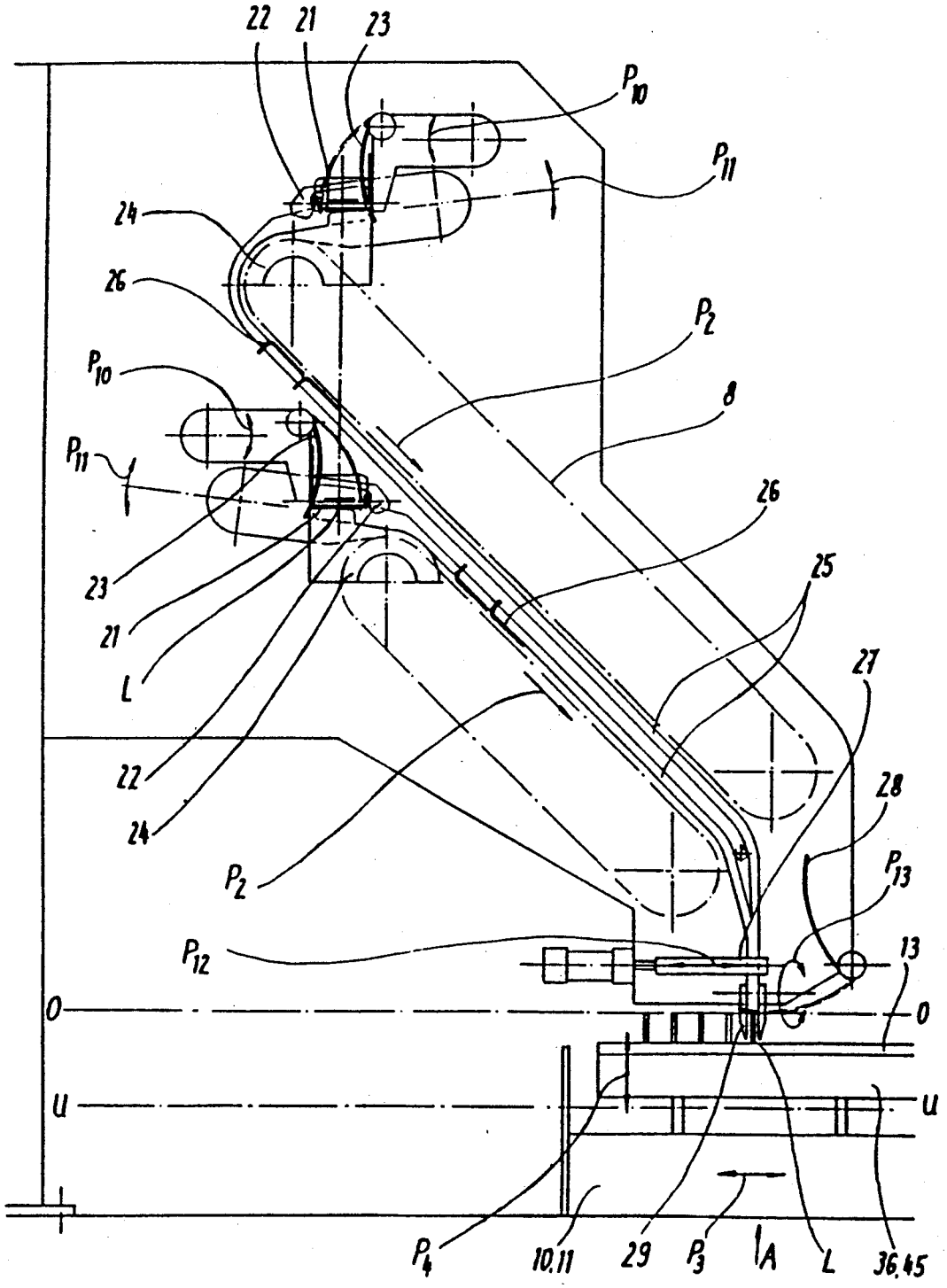
FIG. 2 shows a partial cross-section of the conveying device of the installation.
Figure 2A:
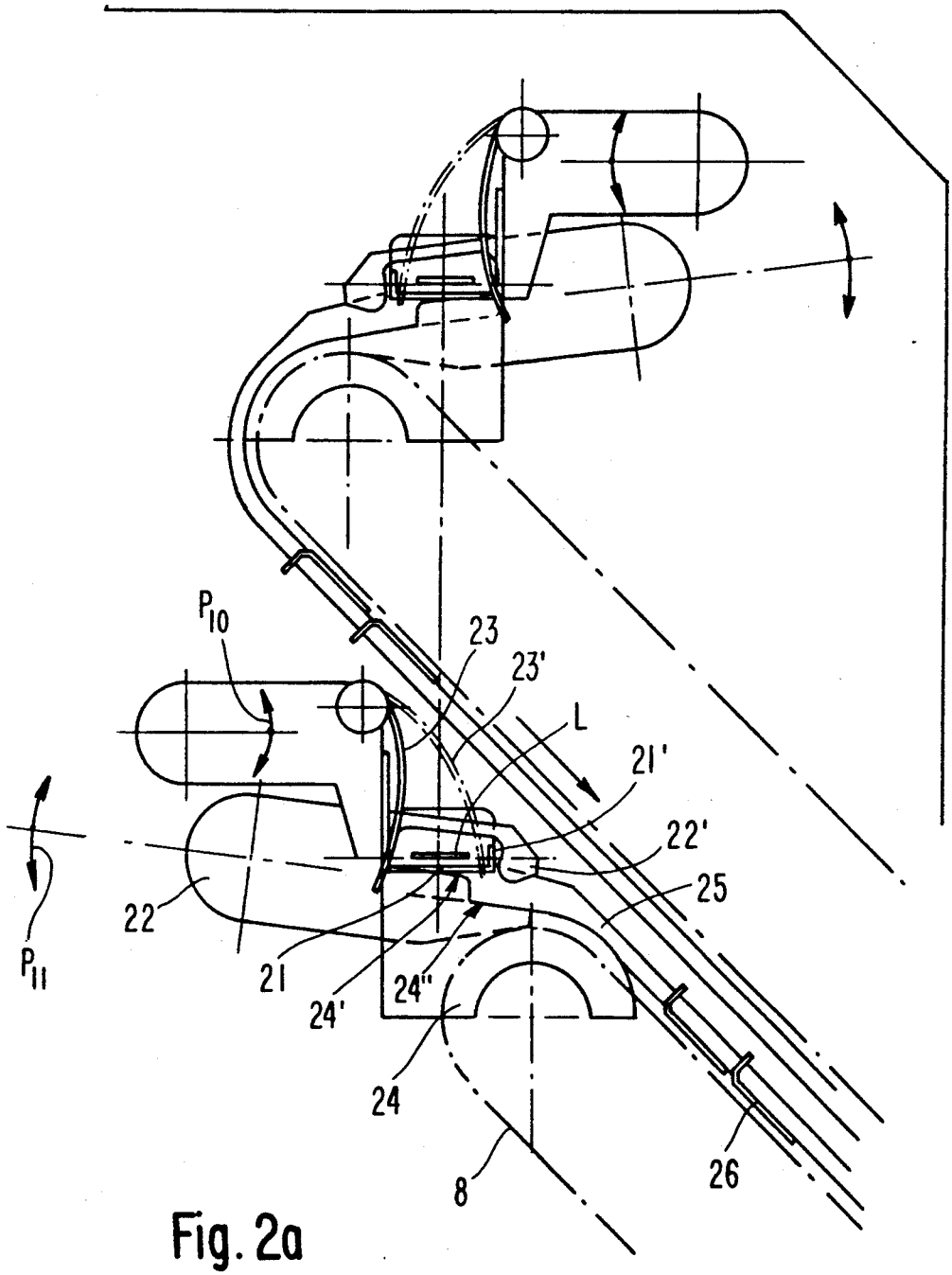

FIG. 2*a* is a fragmentary detailed view of the upper portion of FIG. 2, to an enlarged scale.

Figure 3:
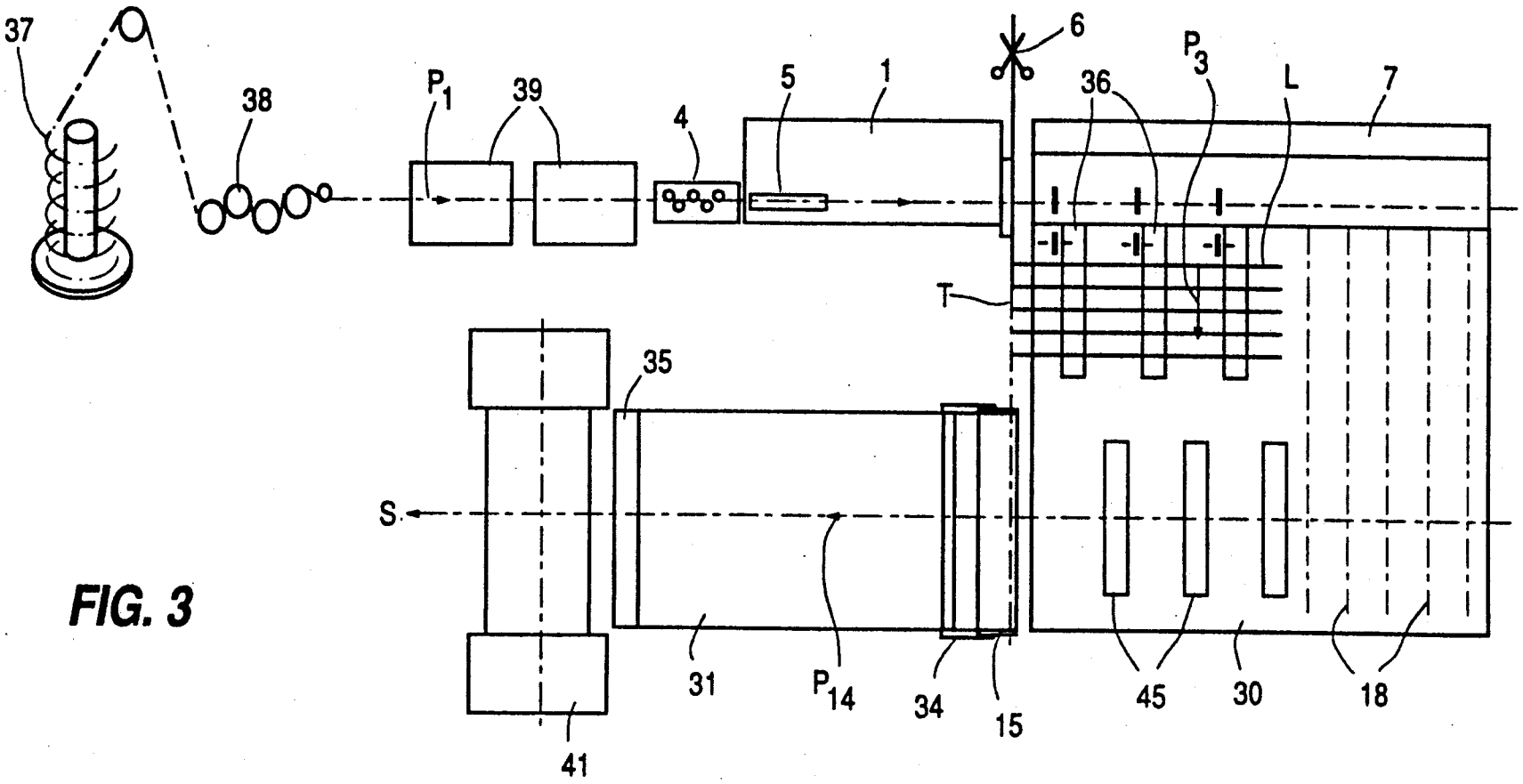
Figure 4A:
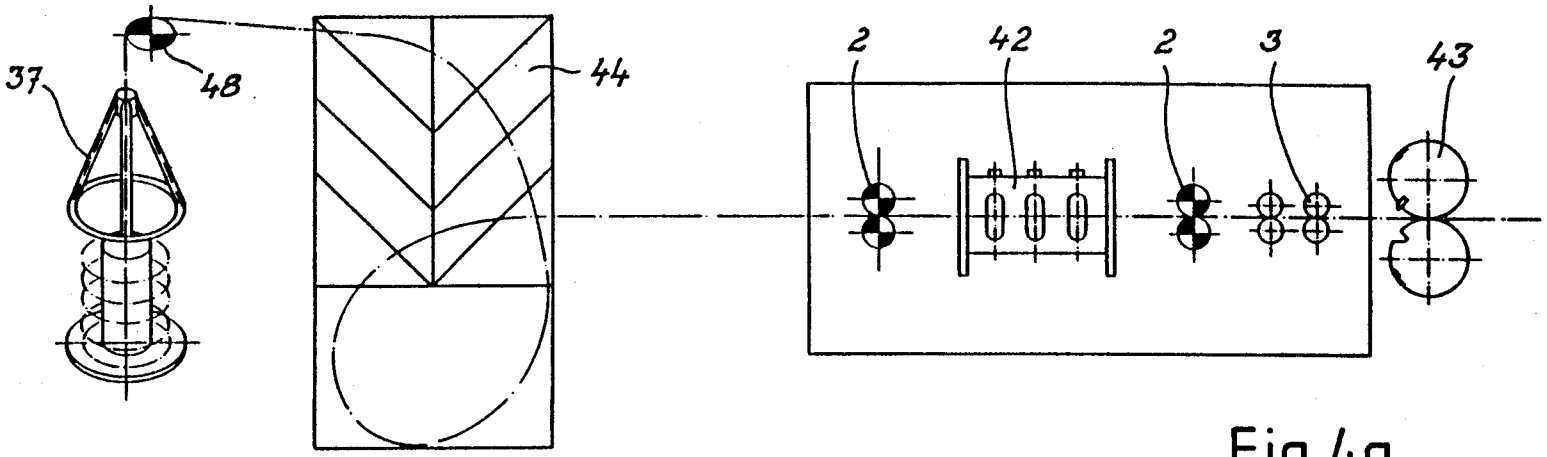
Figure 4B:
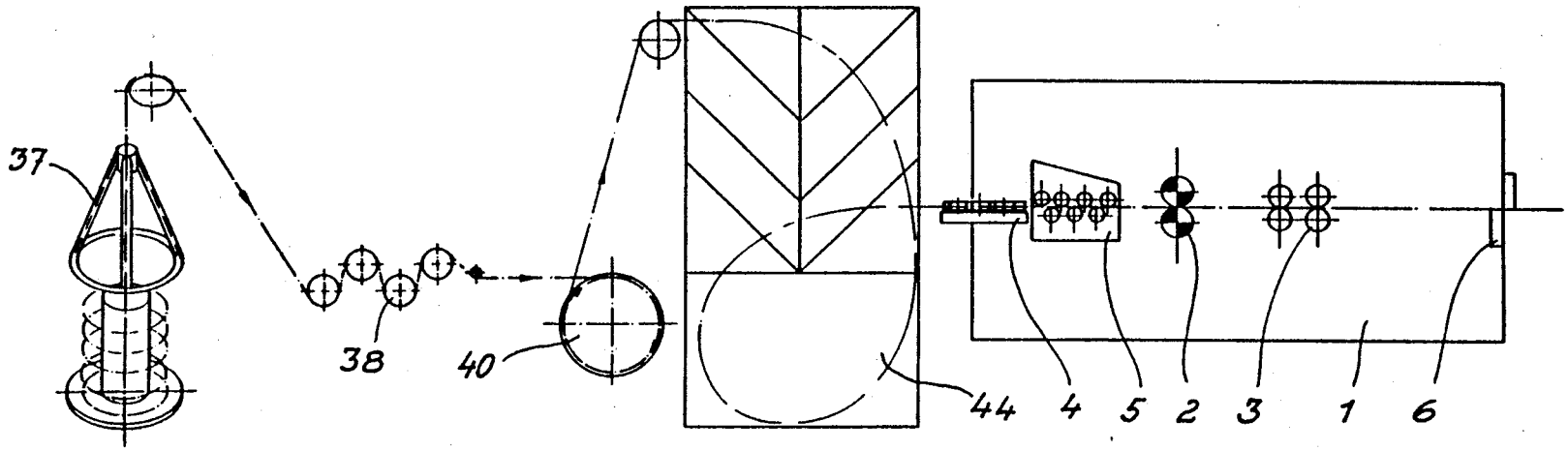

FIG. 3 shows a diagram of the working of the method according to the invention, and FIGS. 4*a* and 4*b* show two further exemplary embodiments of the operating sequence of the method according to the invention.

DETAILED DESCRIPTION

Figure 1:
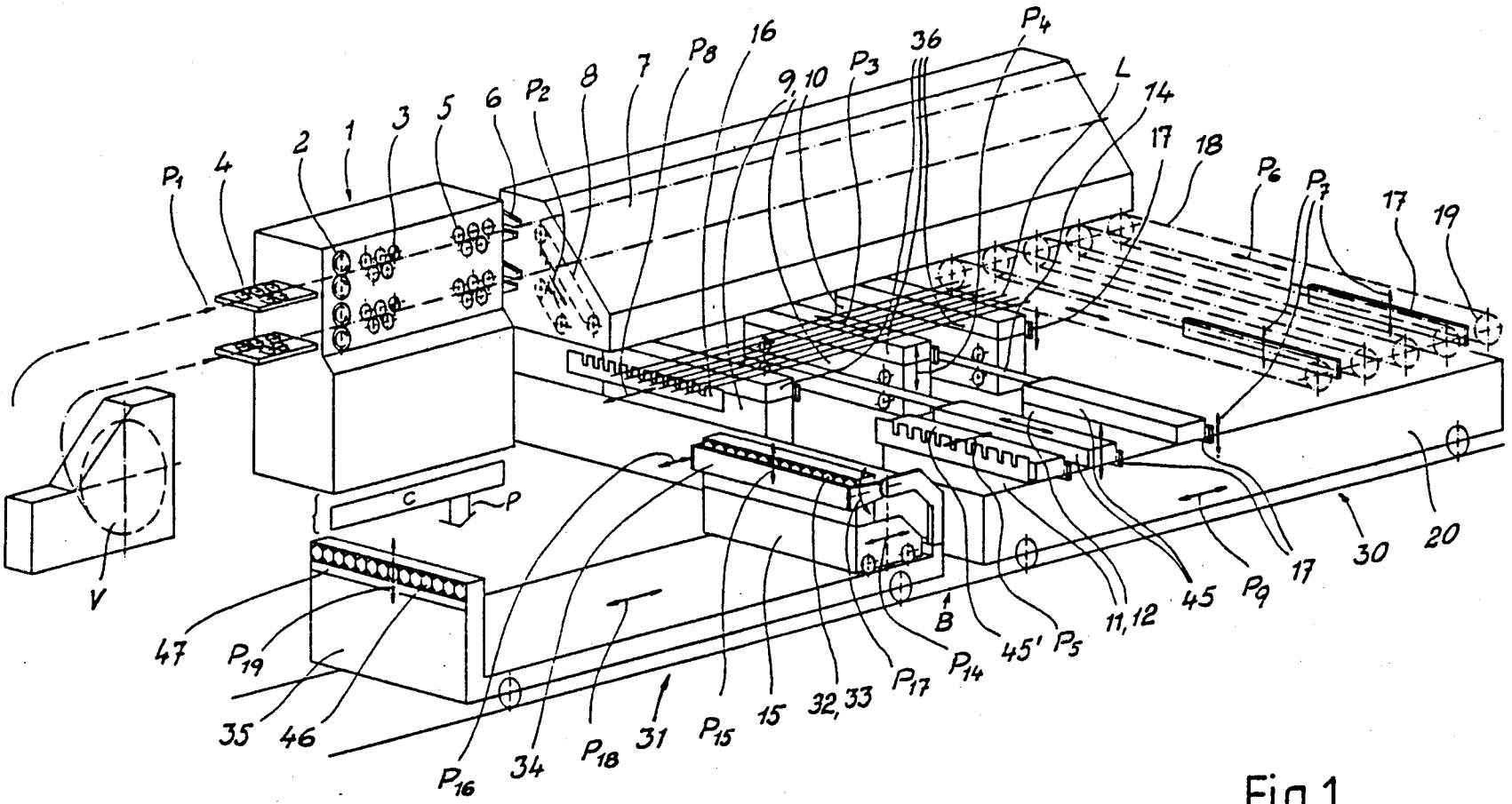
FIG. 1 shows a perspective view of the installation.

In the exemplary embodiment of the invention shown in FIG. 1, two parallel lines of material are drawn off endlessly from supply drums, coils, reels or bundles V and move in the direction of arrow $P_1$ into a feeding device 1. The lines of material can have any cross-section and be made of cold-drawn or hot-rolled material which can be bar-shaped or strip-shaped. FIG. 2, for example, shows strip-shaped supporting bars L as are required for manufacturing welded gratings.

For each line of material, the feeding device 1 essentially has feed members 2 which feed the material into a conveying device 7, a length-measuring wheel 3 and also horizontally acting straightening tools 4 and vertically acting straightening tools 5. Located at the end of the feed path are cutting tools 6 which cut off longitudinal elements L of selectable length from the lines of material.

In the conveying device 7, arranged downstream from the feeding device 1 and shown in particular in FIG. 2, the cut-to-length longitudinal elements L, by means of one allocated, endless conveying chain 8 each which runs at a slope, are conveyed in the direction of arrow $P_2$ onto a distributor carriage 9 of a distributing device 30, which distributor carriage 9 is located in a transfer station A and is movable transversely to the longitudinal elements or transversely to the push-in line S. The longitudinal elements L are received by the distributor carriage 9 in an upper horizontal plane O—O which is predetermined by the welding machine 41 and, depending on the type of welding machine, is defined by the top edges or bottom edges of the longitudinal elements L.

A shown in FIG. 1, two parallel distributor carriages 9 and 12 are provided. Each distributor carriage 9 and 12, in the example shown, consists of three receiving tables 10 and 11 respectively coupled to one another and arranged at a mutual distance behind one another in the direction of the longitudinal elements L. Each receiving table 10 and 11 has a top part 36 and 45 respectively which, for example, can be lifted hydraulically or pneumatically and carries flat electromagnets 13 (FIG. 2) which can be switched off and are designed in a plate shape and by means of which the longitudinal elements L can be releasably secured in place in the transverse direction on the receiving tables 10, 11 at any selectable spacing.

The step-by-step positioning of each distributor carriage 9 and 12 is effected in the direction of arrow $P_3$ transversely to the longitudinal elements in such a way that in each case the section of the distributor carriage provided with a longitudinal element L leaves the transfer station A and a following free carriage section moves into the transfer station A. The step length of this positioning movement is set as a function of the spacing of the longitudinal elements L in the grate or grating to be manufactured. The top parts 36 and 45 of the tables 10 and 11 respectively are located in the raised position when the longitudinal elements L are being received.

Once the distributor carriage 9 shown in FIG. 1 has been completely supplied with the desired number of longitudinal elements L of the grate or grating to be manufactured, it travels horizontally on rails 14 (FIG. 1) in the direction of arrow $P_3$ transversely to the push-in line S (see FIG. 3) to a delivery station B in order to deliver the longitudinal elements L there in groups to a delivery device 31 of the grate-welding machine 41.

To deliver the longitudinal elements L, a push-in carriage 15 of the delivery device 31 is moved in the direction of arrow $P_{14}$ in the direction of the push-in line S towards the receiving tables 10 in such a way that the front ends of the longitudinal elements L are received by receptacles 32, lying side-by-side and designed, for example, in a prism shape, and can be secured in place by means of clamping elements 33 having individually adjustable clamping pressure. During this movement, a comb 16 allocated to the front-most receiving table 10 is at the same time pushed back, the function of which comb 16 will be described later. The electromagnets 13 are switched off and a lifting grid 17 is raised in the direction of arrow $P_7$ in order to lift the longitudinal elements L from the magnet plates 13. The lifting grid 17 consists of a plurality of parts which can be vertically adjusted simultaneously and are allocated to the individual receiving tables 10, 11 as well to as endless distributor chains 18 which are movable transversely to the push-in line S, run over rollers 19 and support the longitudinal elements L at the end of the distributing device 30 remote from the feeding device 1. By actuation of the individual clamping elements 33 or even a common clamping beam for the receptacles 32 of the push-in carriage 15 in the direction of arrow $P_{15}$, the longitudinal elements L are fixed in these receptacles 32. However, the initial clamping force is only selected to be so large that a stop guide bar 34, by moving in the direction of arrow $P_{16}$, can align all longitudinal elements L at the same front projecting length, the longitudinal elements being appropriately displaced in the receptacles 32 in the direction of their longitudinal axis. After the mutual alignment of the longitudinal elements L, the clamping force is increased, the stop guide bar swings up in the direction of arrow $P_{17}$ and thereby clears the feed path for the push-in carriage 15 in the direction of the welding machine 41.

The push-in carriage 15 is arranged so as to be longitudinally displaceable in the direction of arrow $P_{14}$ on a support 35 which in operation is arranged to be stationary relative to the welding machine 41 and is longitudinally displaceable in the direction of arrow $P_{18}$ only for purposes of servicing. During the push-in action into the welding machine 41, the longitudinal elements L are delivered into receptacles 46 of the support 35 which, at the side of the support 35 facing the welding machine 41 are in alignment with the receptacles 32 of the push-in carriage 15. The longitudinal elements L can be individually fixed in these receptacles 46 by actuating clamping elements 47 in the direction of arrow $P_{19}$. The actual operation for delivering the longitudinal elements L to the welding machine 41 and the positioning of the longitudinal elements L under the electrodes of the welding machine 41, as a function of the desired distribution of the longitudinal elements L in the finished grate is effected by interaction of the feed of the push-in carriage 15 and the actuation of its clamping beam 33 or of its individual clamping elements with the actuation of the clamping elements 47 of the stationary support 35.

After the distributor carriage 9 has been unloaded, its top part 36 is lowered in the direction of arrow $P_4$ into a lower horizontal plane U—U (FIG. 2) and, in this plane U—U, returns beneath the longitudinal elements L arranged on the distributor carriage 12 in the direction of arrow $P_3$ into the transfer station A.

As soon as the distributor carriage 9 has reached the transfer station A, the top parts 36 of its receiving tables 10 are lifted in the direction of arrow $P_4$ from the lower horizontal plane U—U into the upper horizontal plane O—O, and the carriage is again ready for transferring longitudinal elements L from the conveying device 7.

As has already been described and shown in FIG. 1, the second distributor carriage 12 can be moved independently of the first distributor carriage 9. The distributor carriage 12, with its receiving tables 11, is arranged in the direction of the longitudinal elements L in each case behind the receiving tables 10 of the first distributor carriage 9, the receiving tables 10 alternating with the receiving tables 11. As a result of this arrangement and on account of the fact that there must be the greatest positional accuracy at the end of the longitudinal elements L adjacent to the feeding device 1 when the longitudinal elements L are received on the receiving tables 10, 11, the top part 45 of the receiving table 11 of the rear distributor carriage 12, which top part 45 is nearest to the feeding device 1, can be divided in the direction of the longitudinal elements The front section 45' of the top part 45 is displaceable in the direction of arrow $P_5$ in the direction of the longitudinal elements L.

The actuating and drive elements for the individual movements are known per se and are not shown for the sake of clarity.

When the longitudinal elements L are delivered to the delivery device 31 of the welding machine, the longitudinal elements L on the distributor carriages 9, 12 need be accurately positioned directly only at the delivery station B. At the end remote from the feeding device 1, accurate positioning of the longitudinal elements L on the distributing device 30 is not necessary. In the exemplary embodiment shown in FIG. 1, the distributor carriages 9, 12 are therefore restricted only to the section of the distributing device adjacent to the feeding device 1. The distributor chains 18 provided instead of the distributor carriages at the end remote from the feeding device 1 are movable in the direction of arrow $P_6$. These distributor chains 18 are only activated at the same time as the distributor carriages 9, 12 when the latter perform a movement in the direction of arrow $P_3$ in the upper horizontal plane O—O. The distributor carriages 9 and 12, which are parallel to each other, can move independently of one another, as described. Consequently, carriage 12 may move during the delivery phase of carriage 9 to be in any position or phase of movement which does not disturb the delivery operation of the carriage 9. For example, carriage 12 may be in the delivery station B with its receiving tables 11 lowered to the lower horizontal plane U—U. It may, also, be on its return travel from the delivery station B back to the transfer station A; it may be in the transfer station A with its receiving tables 11 raised to the upper horizontal plane O—O in order to receive the longitudinal element L; or it may be traveling horizontally from the transfer station A to the delivery station B, already loaded with the desired number of longitudinal elements L on the receiving tables 11 which, in this case, are in their upper horizontal plane O—O.

The comb 16 of the respectively frontmost receiving table 10 and 11, which comb 16 is facultatively provided in addition for aligning the longitudinal elements during the transfer from the conveying device 7, is displaceable in the direction of arrow $P_8$ or in the direction of the longitudinal elements L in order to thereby facilitate the delivery of the longitudinal elements L to the delivery device 31 of the welding machine. The mutual distances between the recesses of these combs 16 correspond to the smallest possible working spacing of the welding machine, and the width of the recesses, in the case of round longitudinal elements, is adapted to the diameters or, in the case of strip-shaped longitudinal elements, is adapted to the dimensions of the narrow sides of these strips. The combs 16 are interchangeable in order to correspond to different spacings.

Furthermore, a base frame 20 on which the conveying device 7 and the distributing device 30 are arranged is shown in FIG. 1. The base frame 20, for the purposes of servicing, is displaceable in the direction of arrow $P_9$ in the direction of the longitudinal elements L.

As shown in FIG. 2, the longitudinal elements L, cut to length by means of the cutting tools 6, are directly received in the conveying device 7 by one allocated pivotable longitudinal-element receiving channel 21 each without longitudinal displacement. By the longitudinal-element receiving channel 21 pivoting downwards in the direction of arrow $P_{10}$ and by upper deflecting fingers 23, present at several locations along the channel 21, at the same time moving from the position shown by a solid line to the position shown by a broken line and also by an ejector 22 subsequently pivoting in the direction of arrow $P_{11}$, the respective longitudinal element L passes over a diverter plate 24, whose contour is adapted to the path of motion of the longitudinal element L, into an allocated inclined feeding duct 25 of the conveying device 7.

Longitudinal elements L can pass from the receiving channel 21 to the feeding duct 25, as shown in FIG. 2, and more particularly in FIG. 2*a* by the following path:

The receiving channel 21 pivots downwards in the direction of arrow $P_{10}$ until the side wall 21' of the receiving channel 21 lies under the inclined lower contour 24'' of the diverter plate 24, thus opening the lateral passage for the longitudinal element L. The longitudinal element L at first falls onto the inclined upper contour 24' of the diverter plate 24 and then slides to the lower contour 24'', additionally pushed by the upper deflecting fingers 23 moving to the position 23' (broken line). In order to make sure that the longitudinal element L is exactly positioned on the contour 24'' to be caught reliably by the transport dogs 26 of chain 8, the ejector 22 pivots downwards in the direction of arrow $P_{11}$. The position of the ejector 22 shown in FIG. 2 shows this lower working position.

The conveying chains 8 rotating in the direction of arrow $P_2$ carry transport dogs 26 of L-shaped design with which each longitudinal element L is conveyed down to the end of the allocated feeding duct 25. The movement of the conveying chains 8 can take place in cycles and is adapted to the ejecting movement of the ejector means formed from the parts 22, 23, 24 as well as to the pivoting movement of the longitudinal-element receiving channel 21. The L-shaped design of the transport dogs 26 prevents the conveying movement from being disturbed by the pivoting of the longitudinal-element receiving channel 21.

Bringing together and appropriately shaping the lower end sections of the feeding ducts 25 ensures that each longitudinal element L released by the transport dogs 26 drops freely onto a locking bar 27 which closes the feeding duct 25 and is movable in the direction of arrow $P_{12}$. By the locking bar 27 being pulled back and by deflecting fingers 28 present at several locations being actuated at the same time, the longitudinal element L passes onto the receiving table 10 and 11 of the distributor carriage 9 and 12 respectively available in each case, the front ends of the longitudinal elements will be located at the same end level or plane as the cutting tools 6, see line T, FIG. 3. The bottom deflecting fingers 28, like the top deflecting fingers 23, are movable between a position shown by a solid line and a position shown by a broken line.

When the locking bar 27 is pulled back it opens the manifold portion of the feeding duct 25 in order to allow the longitudinal element L to pass onto the op parts 36, 45 of the receiving tables 10, 11.

In order to avoid any sticking of the longitudinal elements, especially in the case of long strip-shaped elements, in the feeding duct 25 and to accelerate the ejection of the elements onto the top parts of the receiving tables and deflecting fingers 28 are actuated and move from the position shown in solid lines to the position shown in broken lines and subsequently back to the initial position (solid lines).

In order to prevent tilting, in particular in the case of strip-shaped longitudinal elements disposed edgewise, during the transfer of the longitudinal elements from the conveying device 7 onto the distributor carriages 9 and 12, the feeding duct 25 is extended to just above the top edge of the receiving tables 10, 11 of the distributor carriages 9, 12 by means of guide plates 29 which are pivotable in the direction of arrow $P_{13}$ and are arranged on both sides of the feeding duct 25. This pivoting movement of the guide plates 29 is conveniently effected at the same time as the movements of the locking bar 27 and allocated deflecting fingers 28.

The guide plates 29 extend the feeding duct 25 to just above the surface of the top parts 36, 45 of the receiving tables 10, 11 so that the longitudinal elements L may be guided as long as possible on their way to the receiving tables 10, 11. In order to be able to meet this requirement, the guide plates 29 have to be in their guiding position (as shown in FIG. 2) when a longitudinal element 11 travels along the manifold part of the feeding duct 25 after the locking bar 27 has been pulled back and while the ejection of the longitudinal element L out of the feeding duct 25 is enhanced by moving the deflecting fingers 28 from their initial position (shown in solid line) to the lower position (shown in broken line).

As already described above the deflecting fingers 28 return to their initial position (solid line) while the locking bar 27 moves to the right in order to close the feeding duct 25. Consequently, the guide plates 29 pivot from their guiding position (shown in FIG. 2) so that the receiving tables 10, 11 can be moved to the subsequent receiving position without disturbing the elements already placed on the tables.

Consequently the opposite movement of the guide plates 29 from their "non-distributing position" to their "guiding position" takes place at the same time the locking bar 27 moves to the left in order to open the feeding duct 25 and also at the same time the deflecting fingers 28 move from their initial position (solid line) to their lower position (broken line). On the other hand all of these movements may also be carried out one after another if there is sufficient time.

The preferably alternating feed of two or more longitudinal elements L enables longitudinal elements of different dimensions to be fed to the distributing device or, when longitudinal elements L of the same type are fed, enables the conveying capacity of the conveying device 7 to be doubled.

There are two separate feeding paths for feeding material from the supply drum V via the feed members 2, the cutting tool 6, the receiving channel 21, the transport dogs 26 of the chain 8, the manifold part of the feeding duct 25 to the top parts 36, 45 of the receiving tables 10, 11 waiting in the transfer station A. As a so-called "filling time", i.e. the time required to fill the receiving channel 21 with material, to stop the movement of the material, to cut the material to the desired length of the longitudinal element, to convey the longitudinal element in transverse direction to the transport dogs 26 located on the highest point of the chain 8 and finally to move the chain 8 to feed the longitudinal element to the locking bar 27, is much longer than the so-called "transfer time", i.e. the time necessary to feed the longitudinal element from the locking bar 27 to the top parts 36, 45 of the receiving tables 10, 11 and to bring the receiving tables into a new receiving position, the working capacity of the entire conveying system is limited by the filling time.

As described above, the forward ends of the longitudinal elements L are received by receptacles 32 of the push in carriage 15 of the delivery device 31 and are secured in place by means of clamping elements 33. While the push-in carriage 15 moves towards the receiving tables 10, 11 in order to catch the front ends of the longitudinal elements L, the combs 16 are pushed back in order to clear the way and to facilitate the grasping and securing of the forward ends of the elements by the clamping elements 33. During this operations the longitudinal elements L are still held fast by the electromagnets on the receiving tables. After the forward ends of the longitudinal elements have been secured the electromagnets 13 are switched off and the lifting grids 17 are raised in order to lift the longitudinal elements L from the magnet plates 13 to avoid any damage of these plates while the longitudinal elements L are conveyed longitudinally to the receptacles 46 and further on to the welding machine 41. As the forward ends are firmly secured by the clamping elements 33 the combs 16 are out of operation and therefore it does not matter whether the longitudinal elements L are still in contact with the combs 16 when the grids 17 are in the raised position or not.

In the exemplary embodiment of the invention shown in FIG. 3, hot-rolled material, such as, for example, rolled wire, is fed from a running-off reel 37, for example overhead, via a descaling device 38 to a cold-working device 39 which consists of drawing and/or rolling devices. If necessary, devices for profiling or making ribs can also be provided. If the drawing forces and also the drafts and dimensions of the material to be worked make it necessary, driven roll stands or additional draw-off discs (not shown) can be used.

The cold-worked material passes in line into the feeding device 1, where it is straightened by the straightening tools 4, 5. In the exemplary embodiment shown, these straightening tools conveniently consist of roller-type straightening devices, in which arrangement it has proved to be advantageous to arrange the straightening rollers in at least two planes at right angles to one another. The longitudinal elements L can be cut to size in any length combination by means of the cutting tools 6 provided at the end of the feeding device 1. Since the cutting tools 6 conveniently work intermittently and on the other hand the cold-working device 39 is advantageously operated continuously, an intermediate storage means (not shown) must be provided between the latter and the feeding device 1.

In the conveying device 7 arranged downstream, the longitudinal elements L are shifted individually transversely to their longitudinal direction and delivered to the distributing device 30, in which the longitudinal elements L are fixed non-positively at any selectable spacing on the distributor tables 10, 11 and are then moved in groups in the plane O—O transversely to the push-in line S and are delivered to the delivery device 31 of the welding machine 41. The push-in carriage 15 of this delivery device 31 conveys the longitudinal elements L in groups in their longitudinal direction into the welding machine 41 but now in the opposite direction to the direction of the feeding movement in the feeding device 1. According to the invention, the longitudinal elements L are not displaced in their longitudinal direction after the cutting-off operation; accordingly, the front ends of the longitudinal elements, along their entire path from the cutting tool 6 up to the delivery device 31 move along a line T shown broken in FIG. 3.

FIGS. 4*a* and 4*b* show two further exemplary embodiments according to the invention for feeding material to the conveying device 7. In both cases, the material is hot-rolled material which has already been pretreated in the course of the manufacturing process in such a way that it corresponds in its technical properties to the requirements of the end product and requires no further cold working.

In the exemplary embodiment according to FIG. 4*a*, the material is fed from the running-off reel 37, provided with a drive 48, via an intermediate storage means 44 directly to a straightening device 42 which is designed as a rotor-type straightening machine. A descaling device can be dispensed with, since the scale layer of the material is removed during the straightening operation in the rotor-type straightening device.

Since the rotor-type straightening device 42 preferably works continuously, the cutting tools 6 working intermittently in the exemplary embodiments described hitherto have been replaced by continuously working guillotine shears 43 which are controlled by the length-measuring wheel 3 in accordance with the predetermined length of the longitudinal elements L. The feed mechanism 2 therefore likewise works continuously and can be arranged in front of and/or behind the rotor-type straightening device 42.

In the exemplary embodiment according to FIG. 4*b*, a roller-type straightening device having two straightening tools 4, 5 is used as a straightening device whose straightening rollers are each arranged in two planes disposed at right angles to one another. Since the scale layer of the hot-rolled material cannot be removed in roller-type straightening devices, a separate descaling device 38 has to be connected in front of the straightening tools. To draw off the material from the running-off reel 37 and through the descaling device 38, a draw-off disc 40, e.g. a capstan disc, is necessary in this case so that the reel drive can be dispensed with. Since an intermediate storage means 44 is arranged between the preferably continuously working descaling device 38 and the feeding device 1 in this exemplary embodiment, the cutting tools 6 and the feed mechanism 2 can work intermittently. The cutting tools 6 are again controlled by the length-measuring wheel 3.

To perform the method according to the invention, the various sequences of movement must be exactly coordinated with one another in order to ensure a continuous material flow from the coils or reels up to the welding machine. For this reason, an automatic control system C is present which monitors and controls the individual devices to move in accordance with the respective P-arrows, as schematically shown by the bus P.

In addition, it is possible within the scope of the invention to remove longitudinal elements L already cut to length and straightened from a supply (not shown) and to feed them to the conveying device 7.

We claim:

1. A method of feeding longitudinal elements (L) of round or flat stock material to a welding machine (41) for making gratings, said welding machine defining a push-in line (S) for said elements (L), comprising the steps of:

after straightening, cutting said elements (L) off endless longitudinal element stock material;

locating the cut-off elements (L), with predetermined spacing in a direction transverse to said push-in line, in a group;

subsequently shifting the entire group of said elements into said push-in line;

delivering the shifted group to said welding machine, said method further including the improvement comprising the steps of:

in said locating step, arranging said longitudinal elements (L) in said group on a flat surface with indefinitely, freely selectable spacing between said elements and securing at least the front ends of said longitudinal elements on said flat surface, by applying a positioning force against said elements on said surface;

in said shifting step, moving said elements, in said group, by means of said flat surface directly into said push-in line (S); and in said delivery step, releasing said positioning force and lifting at least the aligned front ends of said longitudinal elements before delivering to said welding machine above the level of said flat surface.

2. The method of claim 1, wherein said positioning force comprises a magnetic force.

3. The method of claim 2, wherein said magnetic force acts on said elements (L) in said group to retain said elements against said flat surface.

4. An installation for feeding longitudinal elements (L) to a welding machine (41) for making grates or gratings, said welding machine defining a push-in line for said elements, said installation having supply means (1, 2, 3, 4, 5, 6) for feeding, straightening and cutting to length a supply of longitudinal element material units and to form said longitudinal elements (L);

an individually separating or singularizing and conveying device (7, 8, 26) oriented parallel to said push-in line (S) for supplying the longitudinal elements (L) to said welding machine (41), and a distributing device (30) arranged downstream from said singularizing and conveying device (7, 8, 26), and movable transversely to said push-in line (S) and to move said longitudinal elements (L) in groups to a delivery device (31) of said welding machine (41), said distributing device (30) comprising a support means (36, 45) for said longitudinal elements which is adjustable vertically with respect to said conveying device, and means (13) operatively associated with said support means for applying a positioning force against said longitudinal elements to retain said longitudinal elements against said support means (36, 45), wherein said conveying device (7, 8, 26) includes at least one channel (21) pivotable about a longitudinal axis thereof for directly receiving said cut-to-length longitudinal elements (L) without longitudinal displacement thereof, and conveying said elements (L), which are arranged downstream from said longitudinal element receiving channel (21), individually along a feeding duct (25) without longitudinal displacement of said elements (L), said feeding duct feeding said elements to said distributing device (30);

wherein said distributing device (30) further including at least two distributer carriages (9, 12), each of which carriages has:

a flat supporting surface (36, 45), forming said support means (36, 45), and vertically adjustable means for vertically adjusting said flat supporting surface between an upper level (O—O) and a lower level (U—U);

said distributor carriages (9, 12) being movable independently of one another transversely to said longitudinal element at a transfer station (A) in step-by-step movement relative to said conveying (7, 8, 26) for placement of said longitudinal elements (L) on said flat supporting surface (36, 45) with freely selectable transverse spacing in accordance with the desired spacing of said longitudinal elements in the finished grating or grate, wherein said distributor carriage (9, 12), when loaded with the longitudinal elements (L) and with the supporting surfaces (36, 45) located at said upper level (O—O), moves from said transfer station (A) directly to a delivery station (B) to deliver said elements (L) to said delivery device (31) of the welding machine (41), said support surfaces (36, 45) of said distributor carriage (9, 12) after delivery of said longitudinal elements, being lowered to said lower level (U—U);

said distributor carriage (9, 12), after delivery of said longitudinal elements (L), moving back to said conveying device (7, 8, 26);

wherein said delivery device (31) of the welding machine (41) includes a push-in carriage (15) movable between the front ends of said longitudinal elements (L) when on said distributor carriages (9, 12), and said welding machine (41), said push-in carriage including an alignment guide bar (34) for aligning said front ends of said longitudinal elements;

a vertically adjustable lifting grid (17) is provided for lifting said longitudinal elements (L) from said flat supporting surfaces (36, 45) of said distributor carriages (9, 12) upon release of said positioning force, said lifting grid (17) lifting said longitudinal elements (L) on said push-in carriage (15), and said alignment guide (34) aligning the front ends of said elements; and control means (C) controlling operation of said devices, said carriages, said lifting grid, and said positioning force means in accordance with a control program for timed operation of the respective devices, carriages, said grid, and said positioning force means.

5. The installation of claim 4, wherein said distributing device (30) has a first portion facing said supply means (1, 2, 4, 5, 6) and a second portion remote from said supply means;

at least one endless support and distributor chain (18) is provided, said chain being movable in the direction of movement of said distributor carriages (9, 12) towards said push-in line (S) for supporting the ends of said elements (L) remote from the leading ends thereof facing the welding machine (41).

6. The installation of claim 4, wherein each of said distributor carriages (9, 12) comprises at least two flat support tables (10, 11), said tables being coupled together and, in the direction of said elements (L), being spaced from each other;

and wherein the supporting surface (45) closest to said supply means (1, 2, 4, 5, 6) of at least that one (12) of the distributor carriages (9, 12) which is rearwardly of the other is separated in the direction of the longitudinal elements; and in which the forward portion (45) of said surface is shiftable in the direction of the longitudinal elements.

7. The installation of claim 4, wherein said conveying device (7) comprises chains (8) with L-shaped transport dogs (26).

8. The installation of claim 4, wherein said at least one channel (21) of the conveying device (7, 8, 26) includes a plurality of deflectable fingers (23), located staggered along the length of said channel, and at least one ejector (22) for moving said longitudinal element (L) into said feeding duct (25).

9. The installation of claim 4, wherein said feeding duct (25) comprises extension guide plates (29), said guide plates (29) being pivotable in the direction of said elements (L) and movable up to the upper edge of said flat supporting surfaces (36, 45) of the distributor carriages (9, 12) which are adjacent the transfer station (A).

10. The installation of claim 8, wherein at least two receiving channels (21) are provided, each channel feeding a respective feeding duct (25);

said at least two feeding channels alternately, or sequentially feeding longitudinal elements to said feeding ducts.

11. The installation of claim 4, wherein said supply means comprises a feeding device (1), straightening tools (5) and cutting tools (6) feeding, straightening and cutting to length at least two longitudinal stock element units. material units pg,25

12. The installation of claim 4, said supply means comprising two straightening tools, acting at right angles to each other, and at right angles to the running direction of the stock element material.

13. The installation of claim 4, wherein said supply means (1, 2, 3, 4, 5, 6) further includes a cold working device (39).

* * * * *